United States Patent [19]

Scherer

[11] Patent Number: 4,526,220

[45] Date of Patent: Jul. 2, 1985

[54] METHOD FOR IMPROVING PERFORMANCE OF CHAPLETS IN METAL CASTING

[76] Inventor: John R. Scherer, 1251 S. Reynolds Rd., Apt. 175, Toledo, Ohio 43615

[21] Appl. No.: 590,164

[22] Filed: Mar. 16, 1984

[51] Int. Cl.[3] ..... B22C 21/14; B22D 33/04

[52] U.S. Cl. ..... 164/137; 106/38.27; 164/398; 427/133

[58] Field of Search ..... 164/131, 132, 72, 102, 164/137, 398, 399, 400; 427/133; 106/38.27

[56] References Cited

U.S. PATENT DOCUMENTS 2,560,258 7/1951 Snyder et al. ..... 164/399

3,945,429 3/1976 Wahlqvist ..... 164/400

*Primary Examiner*—W. D. Bray

*Attorney, Agent, or Firm*—George R. Royer

[57] ABSTRACT

The subject invention is a process for improving the performance capacity of chaplets or spacer supports as used in metal casting as supports adjacent the mold cavity, said process comprising the steps of immersing the chaplet into a water-based solution of borax and thereupon employing the chaplet in the molding process with said solution covering the chaplet.

2 Claims, No Drawings

METHOD FOR IMPROVING PERFORMANCE OF CHAPLETS IN METAL CASTING

DISCUSSION OF BACKGROUND OF INVENTION

The invention herein relates to metal casting of all types, with particular application to sand casting operations. In this respect, there are basically three basic methods of making sand molds for metal casting. One such method is the damp sand mold utilizing silica, clay, and water with the sand. Such wet sand or green sand methods are used generally for all types of castings, metal or otherwise. On the other hand, dry sand mold casting operations are formed by mixing sand of a rather course grain with a clay bonding material and water, and thereupon baking the mixture to a dry state. The dry sand casting is generally used where heavy pieces of substantial detail are to be cast. Dry sand molds are recommended for steel casting operations as well as many other types. A third type of casting is the modified sand mold, utilizing some of the features of both wet and dry sand casting. Moreover, in all types of casting operations, cores are placed in a casting mold in order to create various internal shaped cavities to receive the molten metal in the process.

Irrespective of the type of casting process utilized, as discussed above, the eventual objective and ideal metal casting is to produce a casting of superior quality, at an economical cost. In order to produce castings of superior quality which are free of imperfections, such as the swells, buckles, and waterleaks, among other possible imperfections, auxiliary support devices must be used to preserve the integrity of the mold and maintain the core in its proper position in the mold cavity. In this respect, especially when cores are used to form hollow spaces in the casting, an auxiliary device, commonly referred to as a chaplet, is used as a support to help maintain the mold cavity intact. More particularly, in any metal casting operation, if there is not adequate chaplet support to maintain the mold cavity there may be resultant defects in the final casting product.

A chaplet is usually a small support structure to provide either horizontal or vertical support in the mold cavity. Some authorities alternately use the term "spacer support" in lieu of chaplet, and this former terminology will be used interchangeably with the word "chaplet" in this application. In this regard, there are several types of chaplets in the prior art. First, there are metallic spacer supports, and primary type used in one which has a vertical stanchion post, fitted with an enlarged circular base on both its upper and lower portion. In brief, such chaplets are formed like a spool, with a severely reduced shank. There are a myriad other types of spacer supports or chaplets too numerous to mention or describe herein; however, the functional purpose of each is basically identical.

The problems with the use of the conventional metal chaplets as discussed above are multifold. First, the main problem with nondisintigratible spacer supports, particularly of the metallic variety, is that of the resultant integrity of the casing. Whenever metal or nondisintigratible chaplets are used, the very presence of a foreign metal which is relatively cold compared to the injected molten metal, leads frequently to a problem of casting weakness at such location. More specifically, one of the major problems encountered in this regard is that when molten metal is injected into the mold cavity, and contact of such molten metal with a portion of a relatively colder metal chaplet, that is exposed to the cavity, causes the molten metal to retract slightly from the metal surface of the chaplet, and there is no resultant bonding between the chaplet and the molten metal. The resultant consequences of such lack of bonding, with a slight retraction of the molten metal at such contact point causes a slight imperfection in the cast product, at this contact point, in the form of an indentation or small defect, and these defects may lead to leakers and othe casting defects. This aspect leads to obvious economic disadvantages in the casting process, and this invention is conceived as a means to overcome this difficulty, and the following objects of the subject invention are directed.

OBJECTS

In view of the discussion of the existing art it is the object of the subject invention to provide an improved process for metal casting operations;

Yet another object of the subject invention is to provide an improved process chaplet utilization in metal casting;

Still another object of the subject invention is to provide an improved process for maintaining mold integrity of the mold cavity in metal casting operations;

Another object is to provide a process of producting more effective spacer supports for metal casting operations;

Yet another object of the subject invention is to provide a process for treating metallic chaplets, used in metal casting, so as to yield an improved cast product;

Still another object is to provide an improved method of producing effective chaplets for metal casting operations;

Yet another object is to set forth a process for improving the function of metal chaplets, in metal castings;

Other objects will become manifest from an examination of the specification herein.

DESCRIPTION OF PREFERRED EMBODIMENT

The subject invention herein is a process for coating metal chaplets, used in metal casting, with a film to increase the effectiveness of the casting process. It must be mentioned at this point that the following described process is only one process of several that falls within the scope of the claims. Therefore, the following description shall not be considered as limiting the scope of the subject invention.

The process involved herein involves mainly an application to metal chaplets in metal casting operation, and involves the following steps. First, a water-based solution of borax is prepared. This water-based solution may vary in proportion to the amount of water and borax intermixed, so long as the resultant substance adheres to the metallic surface of the chaplet. The second step is immerse the chaplet, or series of chaplets, into the borax solution. Once the chaplets have been immersed for a period of time to have them sufficiently coated with the borax solution, they are withdrawn. At this point, the chaplet is employed directly in the metal casting operation, or it can be stored for shipment.

Once the borax solution is emplaced on the chaplet it provides a surface coating on the chaplet which yields an optimal bonding between the chaplet surface and the molten metal, causing the exposed surface of the chaplet to be melted to the adjacent surface of the metal casting. This feature prevents casting imperfections leading to leakers or other defects in the cast product.

One of the advantages of using the borax material in water in this process is that borax has a relatively high melting point and this feature combined with its adhesive qualities yields a material that remains on the chaplet surface through all conditions including high temperature exposure.

In addition to the foregoing, it is to be noted that the borax can be applied directly in a dry powder form, without immersing same in water, to the chaplets. This dry powder form has been found to be effective to a degree also.

The foregoing description of the preferred embodiment is directed to one preferred embodiment of the subject invention and the following claims are not to be considered as being limited thereby.

I claim:

1. A method for producing and using a metal chaplet, as used for metal casting operations, comprising the steps of:

(a) immersing said metal chaplet into a mixture of water and borax;

(b) removing said chaplet from said mixture of water and borax;

(c) placing said immersed chaplet into a metal casting mold for use therein.

2. A method for producing and using a metal chaplet, as used for metal casting operations, comprising the steps of:

(a) immersing said metal chaplet into a mixture of water and borax;

(b) placing said immersed chaplet into a metal casting mold for use therein.

* * * * *